United States Patent [19]

Cole

[11] Patent Number: 4,844,418

[45] Date of Patent: Jul. 4, 1989

[54] SHORT STUD TENSIONING APPARATUS

[75] Inventor: William G. Cole, Monroeville, Pa.

[73] Assignee: Westinghouse Electric Corp., Pittsburgh, Pa.

[21] Appl. No.: 20,939

[22] Filed: Mar. 2, 1987

[51] Int. Cl.[4] ..... E21B 19/00

[52] U.S. Cl. ..... 254/29 A; 81/57.38

[58] Field of Search ..... 254/29 A, 29 R, 10.5, 254/30; 29/227, 252, 259, 264, 266; 81/57.38

[56] References Cited

U.S. PATENT DOCUMENTS

| | | | |
|---|---|---|---|
| 2,736,219 | 2/1956 | May | 81/52.4 |
| 3,039,741 | 6/1962 | DeMart | 254/30 |
| 3,077,335 | 2/1963 | Singleton | 254/29 |
| 3,099,434 | 6/1963 | DeMart | 254/29 |
| 3,115,332 | 12/1963 | Singleton et al. | 254/29 |
| 3,123,339 | 3/1964 | DeMart | 254/29 A |
| 3,128,990 | 4/1964 | Brook et al. | 254/29 |
| 3,285,568 | 11/1966 | Biach | 254/29 |
| 3,679,173 | 7/1972 | Sherrick et al. | 254/29 A |
| 3,722,332 | 3/1973 | Jones | 81/57.38 |
| 3,815,874 | 6/1974 | Jones | 254/29 A |
| 3,844,533 | 10/1974 | Markiewicsz et al. | 254/29 A |
| 3,995,828 | 12/1976 | Orban | 254/29 A |
| 4,120,230 | 10/1978 | Bunyan | 85/1 T |
| 4,433,828 | 2/1984 | Spiegelman et al. | 254/29 A |
| 4,438,901 | 3/1984 | Reneau et al. | 254/29 A |
| 4,523,742 | 6/1985 | Reneau | 254/29 A |
| 4,535,656 | 8/1985 | Orban | 81/57.38 |
| 4,708,036 | 11/1987 | Vossbrinck | 254/29 A |

FOREIGN PATENT DOCUMENTS 1382192 1/1975 United Kingdom .

*Primary Examiner*—Frederick R. Schmidt
*Assistant Examiner*—Judy J. Hartman
*Attorney, Agent, or Firm*—Walter S. Stevens

[57] ABSTRACT

Disclosed herein is a short stud tensioning apparatus for tensioning and detensioning an externally threaded stud or bolt protruding a short distance above a surface. The apparatus includes an internally threaded sleeve and a gripper having internal and external threads. The gripper surrounds the stud for threadably engaging the stud and the sleeve surrounds the gripper for threadably engaging the gripper. When engaged on the stud, the gripper serves as an extension of the stud. Hydraulic force is applied to a puller bar which is threadably connected to the gripper so that the gripper travels upwardly when hydraulic force is applied to the puller bar. The upwardly travel of the puller bar causes a correspondingly upward translation of the stud thus tensioning the stud. While the stud is in tension, the sleeve is run down the gripper until the sleeve engages the surface from which the stud protrudes. The stud will thus remain in tension even after the hydraulic force acting on the puller bar is removed. After the tensioning operation is completed, only the sleeve and gripper remain about the stud. Hence, the sleeve and gripper combination replaces the traditional nut. Of course, the stud may be detensioned in a manner similar to its tensioning except that the sleeve is disengaged from the surface by running the sleeve and gripper up the stud.

15 Claims, 3 Drawing Sheets

SHORT STUD TENSIONING APPARATUS

BACKGROUND OF THE INVENTION

This invention relates to a stud tensioning apparatus and method and more particularly to a short stud tensioning apparatus and method for tensioning and detensioning a stud protruding a short distance above a surface.

It is often necessary to pre-tension an externally threaded stud protruding from a surface so that a nut threadably engaged thereon may be tightened against the surface or loosened after it was tightened. This operation may be accomplished using a stud tensioning device.

Stud tensioning devices have been used in many applications requiring the pre-tensioning of a stud or bolt. For example, in the nuclear power industry, stud tensioners are used as an assist for securely attaching reactor pressure vessel heads to reactor pressure vessels. A reactor pressure vessel comprises a generally cylindrical shell open at its top end and having a circumferential vessel flange integrally formed about the perimeter of the upper portion of the shell. The vessel flange includes a plurality of threaded apertures therein for anchoring the ends of a plurality of studs. Housed in the pressure vessel are a plurality of nuclear fuel assemblies submerged in a coolant such as water, which fuel assemblies produce heat that in turn generates electricity in a manner well known in the art of nuclear power production.

The open top end of the pressure vessel is covered by a generally hemispherical reactor pressure vessel head having a circumferential vessel head flange integrally formed about the perimeter of the lower portion of the vessel head. The head flange includes a plurality of holes for receiving the plurality of studs therethrough. Disposed between the head and the vessel is a compressible seal, such as double O-ring gaskets, for obtaining a seal-tight relation between the head and the vessel.

The head is mounted on the top end of the vessel so that the holes formed through the head flange matingly align with the holes formed in the vessel flange. The externally threaded studs are inserted through each hole in the head flange and screwed into the threaded holes formed in the vessel flange so that each stud is anchored in the vessel flange. Next, a nut is threadably engaged on each stud and tightened against the head flange so tht the head becomes bolted to the vessel and so that the seal compresses for obtaining a seal-tight relation between the head and the vessel.

As stated above, the nuclear fuel assemblies which are disposed in the reactor pressure vessel are submerged in a water coolant and produce heat that may raise the coolant temperature to approximately 680 degrees Fahrenheit. In a manner well known in the art, the water is used to ultimately produce steam which in turn generates electricity. However, in order to obtain a reasonable thermal efficiency, the temperature of the water should be raised the maximum extent possible prior to boiling and producing steam. Since the boiling temperature of water as a function of pressure increases as the pressure increases, nuclear power reactor vessels are hence operated at system pressures, which may be approximately 2,500 psia, substantially above atmospheric pressure.

Naturally, the relatively high pressure obtained in the reactor pressure vessel produces a correspondingly high internal pressure on the reactor pressurre vessel head. The internal pressure acting on the vessel head might lift the vessel head away from the vessel and defeat the purpose of the seal disposed between the vessel head and the vessel if the vessel head flange were not securely bolted to the vessel flange by use of the stud and nut combination referred to above. Of course, the stud and nut combination are stressed and tensioned due to the internal pressure acting on the vessel head.

In order to prevent lifting of the head and to maintain the seal-tight relation between the vessel head and the vessel, the stud and nut combination may be pre-tensioned to adequately resist the internal pressure acting against the vessel head. Pre-tensioning the stud and nut combination is accomplished by applying a force to the stud so that the stud is elongated to a predetermined pre-tension value. This pre-tension value should exceed the tension which will be exerted on the stud by the internal pressure acting on the vessel head. The nut is run down the elongated stud and tightened against the head flange so that the pre-tension axial stress in the stud and nut combination is maintained after the force applied to the stud is relaxed. This pre-tensioning operation is typically accomplished using a stud tensioning device.

The typical stud tensioning device employs a gripping means to grip the end of the stud above a nut which is threadably engaged thereon. A force is applied to the gripping means to elongate the stud while the nut is further threadably engaged about the stud and tightened against the flange surface from which the stud protrudes. The force applied to the gripping means is then relaxed and the stud and nut combination remain in pre-tension. When applied to a nuclear reactor pressure vessel, pre-tensioning the stud and nut combination maintains the seal-tight relation between the head and vessel even during reactor heat-up and cool-down. The nut can be removed from the stud by elongating the stud in the manner described above and threadably disengaging the nut from the surface from which the stud protrudes.

However, it is often necessary to pre-tension a stud that protrudes only a relatively short distance from a surface. In this instance there may not be sufficient length of the stud end exposed above the surface to allow appropriate gripping and tensioning of the stud by the tensioning device gripping means.

Although the prior art discloses stud tensioning devices, the prior art des not disclose an efficient short stud tensioning apparatus for tensioning and detensioning a stud protruding only a short distance above a surface.

One such device known in the art of tensioning a stud and nut combination is disclosed by U.S. Pat. No. 4,433,828 issued Feb. 28, 1984 in the name of Stanley R. Speigelman et al. and entitled "Reactor Vessel Stud Closure System" which is assigned to the Westinghouse Electric Corporation. This patent discloses a device for applying tension to and removing tension from a reactor vessel stud and nut combination which attaches a head of a reactor pressure vessel to a reactor vessel in a nuclear power plant. This device comprises a cylindrical gripper sleeve which encloses a split gripper whose plurality of sections are positioned around the lower end of a puller bar and the upper end of the reactor vessel stud. The plurality of sections of the split gripper, when pressed radially inward, from a cylindrically shaped structure comprising as a whole the split gripper which closes around the lower end of the puller bar and the upper end of the vessel stud. Hydraulic force is applied to the puller bar and translated to the vessel stud through the split gripper such that the vessel stud is elongated and tensioned. However, the split gripper must grip the upper end of the vessel stud above the nut engaged thereon; therefore, this device may be most effectively used to grip those studs having sufficient length exposed above the nut from which the stud protrudes for enabling the split gripper to grip the stud.

Another device known in the art for tensioning a stud is disclosed by U.S. Pat. No. 3,077,335 issued Feb. 12, 1963 in the name of John C. Singleton and entitled "Stud Tension". This patent discloses a device for applying tension to large studs in order that the nuts threaded thereon may be tightened or loosened. This device comprises a pedestal having spaced legs adapted to be lowered around each stud and nut and further comprises a cylinder disposed above the pedestal, which cylinder has a piston mounted therein. Threaded on the lower end of the piston is a drawbar having a connector disposed in the drawbar. The connector is threaded onto the stud above the nut. Pressure is applied in a manner that will cause an upward force to be exerted on the drawbar and thus on the connector causing the stud to be elongated. When sufficient force has been exerted on the stud, the nut may be tightened. However, the connector must be threaded onto the upper end of the stud above the nut engaged thereon; therefore, this device may be most effectively used to elongate those studs having sufficient length exposed above the nut from which the stud protrudes to enable the connector to be threaded onto the stud.

A stud tensioning device employing a wedging means is disclosed by U.S. Pat. No. 3,285,568 issued Nov. 15, 1966 in the name of John L. Biach and entitled "Tensioning Apparatus". This patent discloses a tensioning apparatus for precise loading of a stud or bolt having a nut engaged thereon. A puller bar of this tensioning apparatus is adapted to engage with the surfaces of the nut or equivalent structure in a releasable manner. Tensioning means which form part of the apparatus operate to exert a pull on the puller bar and, consequently, tension the bolt through or by means of the nut. Wedge means which may be in the form of a pair of washers having inclined surfaces that may be slid one upon the other to produce a wedging action are interposed between the nut and the surface through which the bolt extends for taking up the slack between the nut and the surfce. Thus, the projecting end of the bolt is provided with a nut or equivalent structure which will, in effect, serve as an extension of the bolt. Although the nut used in this device may serve as an extension of a very short bolt, the device uses wedging means to take up the slack between the nut and the surface through which the bolt extends.

Consequently, while the prior art devices provided stud tensioners that performed with some efficiency, these stud tensioners evinced difficulties in tensioning and detensioning a stud protruding a short distance above a surface.

Therefore, what is needed is an efficient short stud tensioning apparatus and method capable of tensioning and detensioning a stud protruding a short distance above a surface.

SUMMARY OF THE INVENTION

Disclosed herein is a short stud tensioning apparatus and method for tensioning and detensioning an externally threaded stud or bolt protruding a short distance above a surface. The apparatus includes an internally threaded sleeve and a gripping means having internal and external threads. The gripping means surrounds the stud for threadably engaging the stud and the sleeve surrounds the gripping means for threadably engaging the gripping means. When engaged on the stud, the gripping means serves as an extension of the stud. Hydraulic force is applied to a puller bar which is threadably connected to the gripping means so that the gripping means travels upwardly when hydraulic force is applied to the puller bar. The upwardly travel of the puller bar causes a correspondingly upward translation of the stud thus tensioning the stud. While the stud is in tension, the sleeve is run down the gripping means until the sleeve engages the surface from which the stud protrudes. The stud will thus remain in tension even after the hydraulic force acting on the puller bar is removed. After the tensioning operation is completed, only the sleeve and gripping means remain about the stud. Hence, the sleeve and gripping means combination replaces the traditional nut. Of course, the stud may be detensioned in a manner similar to its tensioning except that the sleeve is disengaged from the surface by running the sleeve and gripping means up the stud.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings wherein:

DESCRIPTION OF THE PREFERRED EMBODIMENT

Tensioning and detensioning a stud protruding from a surface may require the use of stud tensioning apparatus. The invention described herein is a short stud tensioning apparatus for tensioning and detensioning an externally threaded stud protruding a relatively short distance above a surface.

Conventional stud tensioning systems require that at least 0.8 times the diameter of the stud protrude above the nut in order properly to attach a tensioning device.

If this additional length of stud is unavailable, the stud must be replaced with one of sufficient length, or torqued, to achieve proper tensioning. Replacement of studs can be expensive and torquing ultimately can cause galling of the threaded stud. With the apparatus and method described herein, short studs can be tensioned by replacing the nuts rather than the studs. This apparatus is reusable and only a sleeve and a gripping means remain with the stud following the tensioning operation. Therefore, the apparatus and method described herein may be used where there is insufficient length of the stud protruding above the nut to use conventional tensioning tools. Instead of replacing expensive studs, this apparatus and method replaces the nut with a sleeve and a gripping means to obtain the proper tension.

Figure 1:
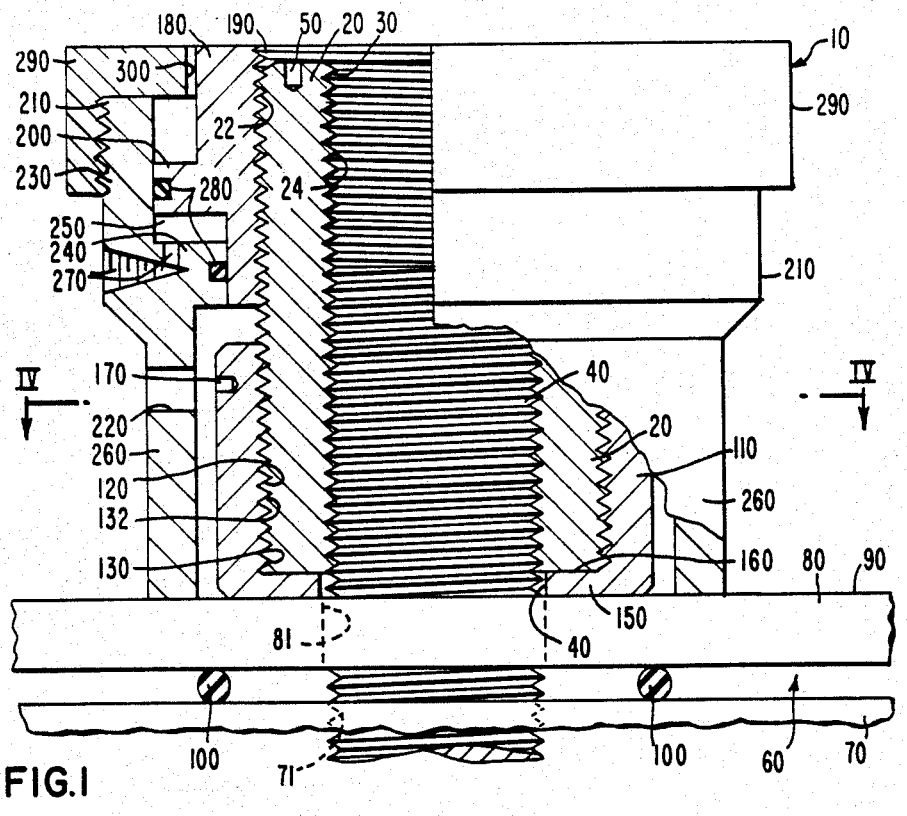
FIG. 1 is a cross-sectional view in partial elevation of a short stud tensioning apparatus surrounding a stud protruding a short distance from a bearing surface.
Figure 2:
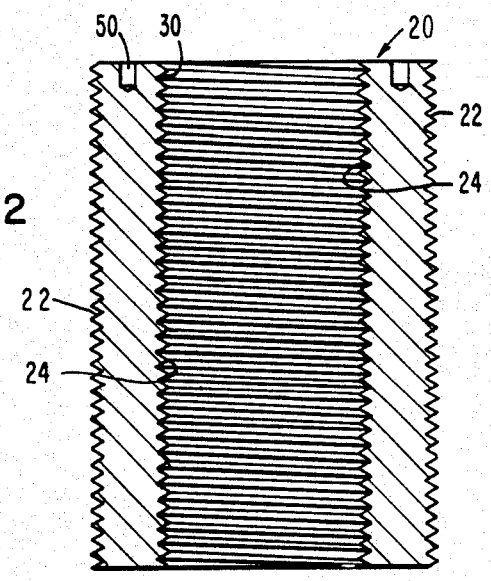
FIG. 2 is a cross-sectional view of a gripping means having internal and external threads.

Referring to FIGS. 1 and 2, the short stud tensioning apparatus is generally referred to as 10 and includes a gripping means 20, which may be a Nitronic 60 steel cylinder approximately three inches in outside diameter, approximately two inchdes in inside diameter and approximately four inches in length. Gripping means 20 includes a plurality of external first threads 22 thereon and a longitudinal first bore 30 therethrough having a plurality of internal second threads 24 for receiving an externally threaded stud 40. Formed in the top-most surface of gripping means 20 are a plurality of first sockets 50 for receiving a wrench (not shown). When received in any of first sockets 50, the wrench is capable of rotating the gripping means 20 about the stud 40, when first bore 30 threadably engages stud 40, such that gripping means 20 rotatably translates upwardly or downwardly along stud 40 depending on the direction of rotation of gripping means 20. Stud 40 may be disposed in an assembly such as a nuclear reactor pressure vessel assembly generally referred to as 60 in FIG. 1. Assembly 60 may include a first flange 70, which may be a reactor pressire vessel flange having a plurality of threaded apertures 71 therein, and a second flange 80, which may be a nuclear reactor pressure vessel head flange having a plurality of holes 81 therethrough and having a bearing surface 90 thereon. Studs 40 may be anchored in first flange 70 when they threadably engage threaded apertures 71 therein. Disposed between first flange 70 and second flange 80, which is movable relative to first flange 70, may be a deformable seal 100 for providing a seal-tight relation between first flange 70 and second flange 80.

Figure 4:
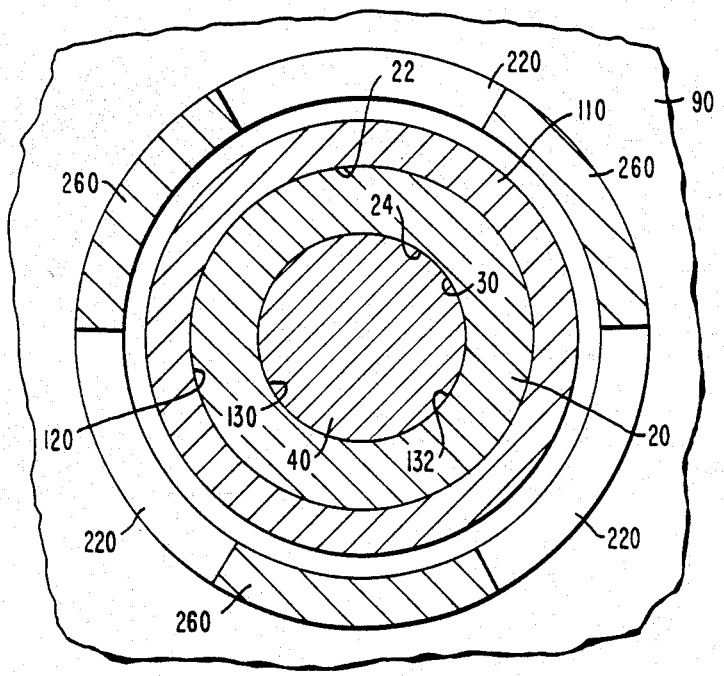
FIG. 4 is a cross-sectional view along line IV—IV of FIG. 1 illustrating a support means having a plurality of access ports therethrough, the sleeve surrounding the gripping means, and the gripping means surrounding the stud.
Figure 3:
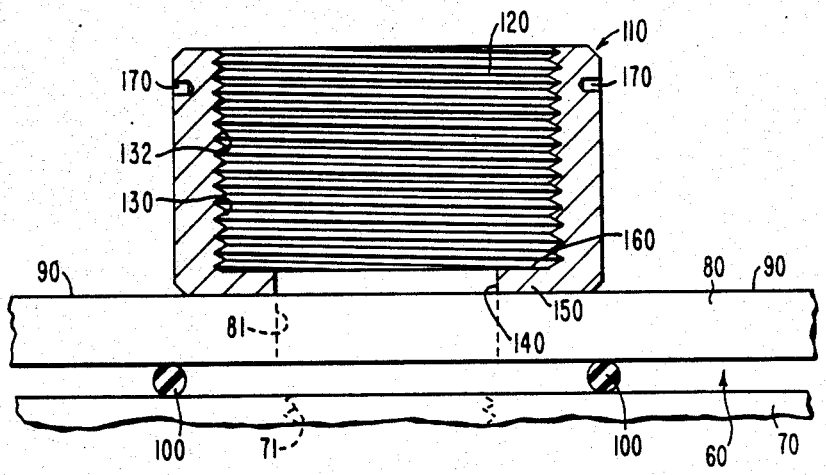
FIG. 3 is a cross-sectional view of a step bore formed in a sleeve resting on the bearing surface.

As best seen in FIGS. 1, 3, and 4, there is illustrated a body which may comprise a cylindrical sleeve 110, which may be a pressure vessel code steel approximately four inches in outside diameter and approximately two inches in length, having a longitudinal second bore 120 therethrough for receiving gripping means 20 and stud 40. Second bore 120 may be a stepped bore having a plurality of third threads 132 therein defining a threaded cylindrical first chamber 130, which may be approximately three inches in diameter and approximately 2.5 inches long, for threadably engaging the lower portion of first threads 22 formed on gripping means 20. The stepped bore may further include a smooth cylindrical second chamber 140 which is smaller than first chamber 130 and which is in communication with first chamber 130. Second chamber 140, which may be approximately two inches in diameter and approximately 0.3 inch long, may be disposed flush again bearing surface 90 for surrounding stud 40. First chamber 130 and second chamber 140 define a circular step 150 integrally formed in the bottom sleeve of sleeve 110. Step 150, having a step surface 160 thereon, may support the bottom-most end of gripping means 20, when gripping means 20 is threadably engaged in first chamber 130, such that the bottom-most end of gripping means 20 may repose on step surface 160. Formed in the exterior surface of sleeve 110 are a plurality of second sockets 170 for receiving a tightening means such as a wrench (not shown). When received in any of second sockets 170, the wrench is capable of rotating sleeve 110 about gripping means 20, when third threads 132 formed in first chamber 130 threadably engage gripping means 20, so that sleeve 110 rotatably translates upwardly or downwardly along gripping means 20 depending on the direction of rotation of sleeve 110.

As illustrated in FIG. 1, a pulling means which may be a generally cylindrical puller bar 180 having a longitudinal threaded third bore 190 therethrough threadably surrounds the upper portion of externally threaded gripping means 20. The upper portion of external first threads 22 of gripping means 20 threadably engages the threads formed in third bore 190. Integrally formed with puller bar 180 and perpendicularly extending a predetermined distance from the exterior surface thereof is a rectangularly shaped lifting ledge 200 extending circumferentially around the exterior surface of puller bar 180 for lifting puller bar 180 upwardly. As described below in more detail, a motor means acts on the puller bar for translating the puller bar upwardly and downwardly. When puller bar 180 is lifted upwardly it exerts sufficient upward force on gripping means 20 to lift gripping means 20 away from bearing surface 90 due to the threaded engagement of puller bar 180 and gripping means 20. The lifting of gripping means 20 away from bearing surface 90 elongates stud 40 so that stud 40 is tensioned.

Still referring to FIG. 1, there is illustrated a cylindrical support means 210 surrounding puller bar 180 for supporting puller bar 180. Support means 210, which also surrounds sleeve 110, includes a plurality of access ports 220 therethrough for receiving a wrench (not shown) and for providing access to sleeve 110. Access ports 220 are aligned with second sockets 170, which are formed in sleeve 110, so that the wrench may be inserted through access ports 220 and into second sockets 170 for threadably rotating sleeve 110 about gripping means 20. Support means 210 is further defined by an L-shaped upper portion having a vertical leg 230 and a circumferential shelf 240, which shelf 240 is perpendicular to vertical leg 230 and integrally formed therewoth for supporting lifting ledge 200. Vertical leg 230 slidably contacts lifting ledge 200 and perpendicular shelf 249 slidably contacts the exterior surface of puller bar 180 below lifting ledge 200 for allowing puller far 180 to slidably translate upwardly and downwardly. Vertical leg 230, lifting ledge 200, exterior surface of puller bar 180 below lifting ledge 200, and shelf 240 define an annular expansible cavity 250 when lifting ledge 200 is lifted away from shelf 240. As described below, cavity 250 is capable of being pressurized and depressurized by the introduction of hydraulic fluid into cavity 250, which hydraulic fluid may be an oil based liquid such as UCON WS-34 available from Union Carbide Corporation. The hydraulic fluid exerts an hydraulic force on the bottom surface of lifting ledge 200 for translating lifting ledge 200 either upwardly or downwardly depending on whether cavity 250 is pressurized or depressurized respectively. Integrally formed with the bottom end of the L-shaped upper portion formed in support means 210 and surrounding sleeve 110 is a cylindrical vertical lower portion defining a skirt 260 having access ports 220 therethrough for accessing sleeve 110. The bottom end of skirt 260 rests on bearing surface 90 for thrusting against bearing surface 90 when cavity 250 is pressurized or depressurized. Formed in support means 210 is a channel 270 extending from cavity 250 to the exterior surface of support means 210 to provide a path for hydraulic fluid flow to and from cavity 250 through channel 270. Connected to channel 270 is a hydraulic fluid supply means (not shown) in fluid communication with channel 270 for providing hydraulic fluid to channel 270 and for hydrostatically pressurizing and depressurizing cavity 250. A sealing means 280 is disposed in tensioning apparatus 10 near cavity 250 for sealing cavity 250.

As shown in FIG. 1, a cylindrical retaining means 290, having a stepped fourth bore 300 therethrough for surrounding the upper portion of puller bar 180 and for surrounding the upper portion of support means 210, is attached to the top portion of support means 210. Fourth bore 300 may have threads therein for threadably engaging a plurality of external threads which may be formed on the external surface of vertical leg 230. Retaining means 290 retains and limits the upward travel of puller bar 180 when stud 40 is tensioned so that stud 40 is not excessively tensioned.

Figure 5:
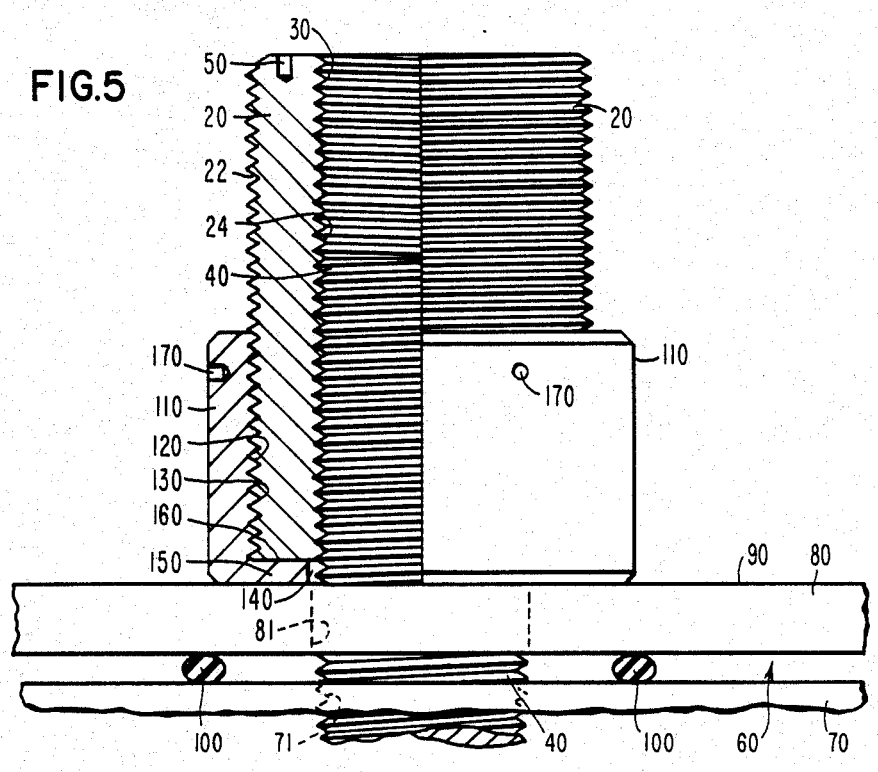
FIG. 5 is a cross-sectional view in partial elevation illustrating the sleeve contacting the bearing surface and threadably engaging the gripping means which surrounds the stud protruding from the bearing surface.

As best seen in FIG. 5, gripping means 20 remains threadably engaged on stu 40 and sleeve 110 remains threadably engaged on gripping means 20 after puller bar 180, support means 210, and retaining means 290 are removed following tensioning of stu 40. The resulting combination of gripping means 20 and sleeve 110 is commonly referred to in the art as a split nut.

Figure 6:
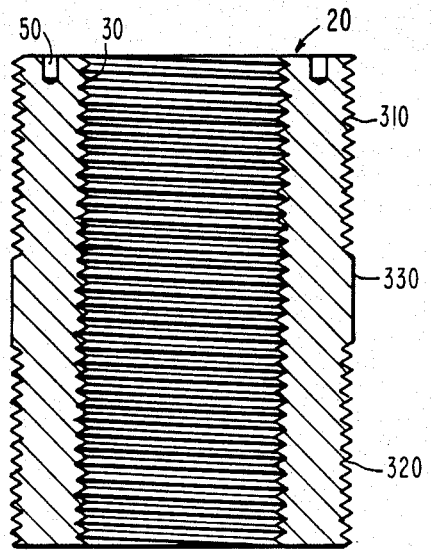
FIG. 6 is a cross-sectional view illustrating a second embodiment of the gripping means.

Referring to FIG. 6, there is illustrated a second embodiment of gripping means 20 having second threads 24 defining first bore 30 therethrough for receiving stud 40. The second embodiment of gripping means 20 includes a plurality of upper external fourth threads 310 formed on the upper portion of the exterior surface of gripping means 20 for threadably engaging the threads disposed in third bore 190 which is formed in puller bar 180 (see FIG. 1). Gripping means 20 further includes a plurality of lower external fifth threads 320 formed on the lower portion of the exterior surface of gripping means 20 for threadably engaging third threads 132 which are formed in sleeve 110 (see FIG. 1). Fourth threads 310 and fifth threads 320 are separated by a smooth surface 330 which is disposed on the exterior surface of gripping means 20.

During operation, the externally threaded stud 40 protruding from the bearing surface 90 is selected for tensioning. The longitudinal axis of gripping means 20 is aligned with the longitudinal axis of sleeve 110 whereupon gripping means 20 is threadably engaged into first chamber 130 which is formed in sleeve 110 for receiving gripping means 20. The longitudinal axes of gripping means 20 and sleeve 110, which sleeve 110 is now engaged on gripping means 20, are aligned with the longitudinal axis of stud 40 and orientated such that the working face of step 150 is capable of contacting bearing surface 90. Gripping means 20, having sleeve 110 engaged thereon, is threadably engaged onto stud 40 by threadably engaging stud 40 into threaded first bore 30. A wrench (not shown) is inserted into any of sockets 50, which are formed in the top-most surface of gripping means 20, and rotated such that gripping means 20 and sleeve 110 rotatably translate along stud 40 until step 150 connects bearing surface 90. Next, the longitudinal axis of support means 210, which includes a longitudinal opening therethrough, is aligned with the longitudinal axis of stud 40. Support means 210 is positioned about gripping means 20 and sleeve 110 so that support means 210 surrounds gripping means 20 and sleeve 110 and so that the bottom-most end of skirt 260 rests on bearing surface 90. As described above, the longitudinal opening in support means 210 defines shelf 240 therein for supporting lifting ledge 200 which is integrally formed in puller bar 180. The longitudinal axis of puller bar 180 is aligned with the longitudinal axis of gripping means 20. Puller bar 180 is then threadably engaged onto gripping means 20 so that the upper portion of gripping means 20 threadably engages third bore 190 which is formed in puller bar 180. Puller bar 180 is positioned on gripping mans 20 such that cavity 250 is defined by lifting ledge 200, shelf 240, vertical leg 230 and puller bar 180. Finally, retaining means 290 is threadably attached to vertical leg 230 by engaging the internal threads formed in retaining means 290 with the external threads formed on vertical leg 230.

After tensioning apparatus 10 is assembled about stud 40, an hydraulic fluid supply means (not shown) is connected to channel 270 which in turn is connected to cavity 250. Hydraulic fluid is supplied to cavity 250 from the hydraulic fluid supply means through channel 270 which connects cavity 250 and the hydraulic fluid supply means. When hydraulic fluid flows into cavity 250, cavity 250 becomes pressurized thereby, which pressurization exerts an upward hydraulic force on lifting ledge 200 which is integrally formed in puller bar 180. The pressure allowed in cavity 250 depends primarily on the diameter and tensile strength of the stud to be tensioned. Lifting ledge 200 lifts upwardly as cavity 250 is pressurized and as the hydraulic force acts on lifting ledge 200. When lifting ledge 200 lifts upwardly, gripping means 20 translates upwardly a corresponding distance due to the threaded engagement of gripping means 20 and threaded third bore 190 formed in puller bar 180. As gripping means 20 translates upwardly it exerts an upwardly force on stud 40 due to the threaded engaagement of stud, 40 and first bore 30 which is formed through gripping means 20. One end of stud 40 may be anchored in first flange 70; therefore, stud 40 elongates with gripping means 20 exerts an upwardly force on stud 40. Naturally, as stud 40 elongates, it is placed in tension. The amount of tension in stud 40 is controlled by the amount of hydraulic force acting on lifting ledge 200 which force is in turn controlled by the amount of hydraulic fluid entering cavity 250. The amount of tension may be measured by a tensionometer (not shown) or strain gauge (not shown) which may be connected to stud 40.

When stud 40 obtains the required tension the wrench (not shown) is inserted through any of access ports 220 and engaged in any of second sockets 170 and rotated such that sleeve 110 rotatably translates along gripping means 20 until sleeve 110 tightens against bearing surface 90; therefore, the wrench is used to torque sleeve 110 about gripping means 20 until the bottom-most end of sleeve 110 sufficiently engages bearing surface 90. The wrench is then removed from second socket 170 through access port 220 after sleeve 110 sufficiently engages bearing surface 90.

After sleeve 110 sufficiently engages bearing surface 90, hydraulic fluid is then drained from cavity 250. The hydraulic fluid may be drained from cavity 250 by allowing the hydraulic fluid to return to the fluid supply means (not shown) through channel 270. When the hydraulic fluid is sufficiently drained from cavity 250, cavity 250 becomes depressurized thereby such that the upward hydraulic force acting on lifting ledge 200 is reduced or eliminated depending on the amount of depressurization of cavity 250. When the upward force acting on lifting ledge 200, which is formed in puller bar 180, is reduced or eliminated the upward force acting on gripping means 20 is correspondingly reduced or eliminated due to the threaded engagement of puller bar 180 and gripping means 20. As the upward force acting on gripping means 20 is reduced or eliminated, the upward force acting on stud 40 is correspondingly reduced or eliminated due to the threaded engagement of gripping means 20 and stud 40.

After stud 40 is tensioned in the manner described immediately above, tensioning apparatus 10 is disassembled so that gripping means 20 remains engaged on stud 40 and sleeve 110 remains engaged on gripping means 20 as shown in FIG. 5. In this regard, tensioning apparatus 10 is disassembled by first disengaging retaining means 290 from support means 210. Next, puller bar 180 is disengaged from gripping means 20 and support means 210. Finally, support means 210 is removed from the vicinity of stud 40. Thus, disassembly of tensioning apparatus 10 after pre-tensioning is accomplished in a fashion that is substantially the reverse of its initial assembly before pre-tensioning stud 40.

Of course, detensioning stud 40 is accomplished in a manner similar to tensioning stud 40. In this regard, the process described above for tensioning stud 40 is followed except that the wrench, which is inserted into second sockets 170, is rotated so that sleeve 110 is disengaged from bearing surface 90.

It should be noted that the specification provided above is broad enough to include all types of threaded studs and bolts. In addition, the surface 90 may be any type of surface such as a flange surface, cover surface or housing surface. Moreover, it should be evident that the tensioning apparatus disclosed herein provides a sleeve which may be threaded for different sized stud threads and also provides an apparatus that can be sized for virtually any size stud.

Therefore, this invention provides a short stud tensioning apparatus and method for tensioning and detensioning a stud protruding a short distance from a surface.

What I claim is:

1. A short stud tensioning apparatus for tensioning a stud protruding from a bearing surface comprising:

(a) a gripping means engaging said stud for gripping said stud and for elongating said stud along its longitudinal axis;

(b) a body threadably engaging said gripping means, said body capable of being tightened against said surface, said body including a step on which said gripping means rests, wherein said step extends inwardly toward said stud but does not contact said stud;

(c) means connected to said body for tightening said body against said surface; and (d) pulling means separate from said body, said pulling means engaging the gripping means such that actuation of said pulling means tensions the stud.

2. The apparatus according to claim 1, wherein the short stud tensioning apparatus further comprises a pulling means threadably engaging said gripping means for pulling said gripping means along its longitudinal axis.

3. The apparatus according to claim 2, wherein the short stud tensioning apparatus further comprises:

motor means in communication with said pulling means for translating said pulling means upwardly and downwardly.

4. The apparatus according to claim 3, wherein the short stud tensioning apparatus further comprises a support means slidably contacting said pulling means and resting on said surface for supporting said pulling means, said support means having a plurality of access ports therethrough for access to said body.

5. The apparatus according to claim 4, wherein the short stud tensioning apparatus further comprises a retaining means attached to said support means for retaining and for limiting the upward travel of said pulling means.

6. A short stud tensioning apparatus for tensioning an externally threaded stud protruding from a bearing surface comprising:

(a) a cylindrical gripping means surrounding said stud for gripping said stud and for elongating said stud along its longitudinal axis, said gripping means having a threaded first bore therethrough for threadably receiving said stud;

(b) a plurality of upper external threads formed on the upper portion of the external surface of said gripping means;

(c) a plurality of lower external threads formed on the lower portion of the external surface of said gripping means;

(d) a smooth surface separating said upper external threads and said lower external threads;

(e) a cylindrical sleeve surrounding the lower portion of said gripping means, said sleeve having a threaded second bore therethrough for threadably engaging said cylindrical sleeve including a step on which said gripping means rests, wherein said step extends inwardly toward said stud but does not contact said stud;

(f) means connected to said cylindrical sleeve for tightening said cylindrical sleeve against said surface; and (g) pulling means separate from said sleeve, said pulling means engaging the gripping means such that actuation of the pulling means tensions the stud.

7. The apparatus according to claim 6, wherein the short stud tensioning apparatus further comprises a cylindrical puller bar surrounding the upper portion of said gripping means for translating said gripping means upwardly and downwardly, said puller bar having a threaded third bore therethrough for threadably engaging the external threads formed on the upper portion of the external surface of said gripping means.

8. A short stud tensioning apparatus for tensioning an externally threaded stud protruding from a bearing surface comprising:

(a) a cylindrical gripping means surrounding said stud for gripping said stud and for elongating said stud along its longitudinal axis, said gripping means having a threaded first bore threthrough for threadably receiving said stud, said gripping means having external threads thereon;

(b) a cylindrical sleeve surrounding the lower portion of said gripping means, said sleeve having a threaded second bore therethrough for threadably engaging the external threads of said stripping means, said sleeve capable of being tightened against said bearing surface when threadably engaging said gripping means, said second bore including a step on which said gripping means rests, wherein said step extends inwardly toward said stud but does not contact said stud;

(c) means connected to said cylindrical sleeve for tightening said cylindrical sleeve against said surface; and (d) a cylindrical puller bar surrounding the upper portion of said gripping means for translating said gripping means upwardly and downwardly, said puller bar having a threaded third bore therethrough for threadably engaging the external threads of said gripping means.

9. The apparatus according to claim 8, wherein the short stud tensioning apparatus further comprises a motor means in communicating with said puller bar for translating said puller bar upwardly and downwardly.

10. The apparatus according to claim 8, wherein the short stud tensioning apparatus further comprises a cylindrical support means surrounding said sleeve and surrounding a portion of said puller bar for supporting said puller bar, said support means having a plurality of access ports therethrough aligned with said sleeve for access to said sleeve.

11. The apparatus according to claim 10, wherein the short stud tensioning apparatus further comprises a retaining means attached to the upper portion of said support means for retaining and for limiting the upward travel of said puller bar.

12. The apparatus according to claim 10, wherein the support means further comprises:

(a) a cylindrical vertical leg having threads on the external surface thereof;

(b) a circumferential shelf perpendicular to said vertical leg and integrally formed with the bottom-most end thereof, said shelf slidably contacting the external surface of said puller bar for allowing said puller bar to slidably translate upwardly and downwardly;

(c) a cylindrical L-shaped upper portion defined by said vertical leg and by said shelf and slidably contacting said puller bar for allowing said puller bar to slidably translate upwardly and downwardly; and (d) a cylindrical vertical skirt disposed on the bottom end of said L-shaped upper portion and integrally formed therewith for supporting said L-shaped upper portion, the bottom-most end of said skirt resting on said bearing surface, said skirt having access ports therethrough for access to said sleeve.

13. The apparatus according to claim 12, wherein said puller bar further comprises a lifting ledge disposed on the exterior surface of said puller bar and integrally formed therewith and normal thereto for lifting said puller bar upwardly and downwardly.

14. The apparatus according to claim 13, wherein said puller bar further comprises:

(a) a cylindrical, expansible cavity defined by said L-shaped portion and said lifting ledge, said cavity capable of receiving hydraulic fluid to pressurize and depressurize said cavity for lifting said puller bar upwardly and downwardly;

(b) a channel extending from said cavity to the exterior surface of said support means to provide a path for hydraulic fluid flowing through said channel to and from said cavity;

(c) an hydraulic fluid supply means in fluid communication with said channel for providing hydraulic fluid to said channel and for providing pressurization and depressurization of said cavity; and (d) a sealing means disposed near said cavity for sealing said cavity.

15. The apparatus according to claim 11, wherein said retaining means further comprises a cylindrical member having a stepped fourth bore therethrough for surrounding the upper portion of said puller bar and the upper portion of said support means, said fourth bore having threads therein for threadably engaging the external threads of said support means, said retaining means mounted on the top of said support means.

* * * * *